US006012805A

United States Patent [19]

Hawkins et al.

[11] Patent Number: 6,012,805

[45] Date of Patent: Jan. 11, 2000

[54] CONTINUOUS INK JET PRINTER WITH VARIABLE CONTACT DROP DEFLECTION

[75] Inventors: Gilbert A. Hawkins; Constantine N. Anagnostopoulos, both of Mendon; James M. Chwalek, Pittsford; David L. Jeanmaire, Brockport, all of N.Y.

[73] Assignee: Eastman Kodak Company, Rochester, N.Y.

[21] Appl. No.: 08/953,525

[22] Filed: Oct. 17, 1997

[51] Int. Cl.[7] ..... B41J 2/105

[52] U.S. Cl. ..... 347/82

[58] Field of Search ..... 347/77, 82, 72, 347/73, 74, 75

[56] References Cited

U.S. PATENT DOCUMENTS

| | | | |
|---|---|---|---|
| 1,941,001 | 12/1933 | Hansell . | |
| 3,373,437 | 3/1968 | Sweet et al. . | |
| 3,416,153 | 12/1968 | Hertz et al. . | |
| 3,709,432 | 1/1973 | Robertson | 347/82 |
| 3,878,519 | 4/1975 | Eaton . | |
| 3,893,623 | 7/1975 | Toupin | 347/82 |
| 3,916,421 | 10/1975 | Hertz . | |
| 3,979,756 | 9/1976 | Helinski et al. . | |
| 4,148,718 | 4/1979 | Fulwyler . | |
| 4,230,558 | 10/1980 | Fulwyler . | |
| 4,283,730 | 8/1981 | Graf | 347/82 |
| 4,318,483 | 3/1982 | Lombardo et al. . | |
| 4,346,387 | 8/1982 | Hertz . | |
| 4,646,106 | 2/1987 | Howkins . | |
| 5,160,939 | 11/1992 | Bajeux et al. . | |

FOREIGN PATENT DOCUMENTS

| | | | |
|---|---|---|---|
| 635185 | 2/1962 | Italy | 347/82 |

*Primary Examiner*—N. Le
*Assistant Examiner*—Thien Tran
*Attorney, Agent, or Firm*—Milton S. Sales

[57] ABSTRACT

Apparatus is disclosed for controlling ink in a continuous ink jet printer in which a continuous stream of ink is emitted from a nozzle, wherein an ink stream generator establishes a continuous flow of ink in a stream such that the stream breaks up into a plurality of droplets at a position spaced from the ink stream generator. A stream deflector includes a body having a surface positioned adjacent to the stream between the ink stream generator and the position whereat the stream breaks up into droplets such that the stream contacts the surface and is deflected at least in part due to a tendency of liquid to contact a surface in proportion to liquid-solid free energy. The stream may be deflected substantially totally due to a tendency of liquid to contact a surface in proportion to liquid-solid free energy, or may be deflected partially due to a tendency of liquid to contact a surface in proportion to liquid-solid free energy and partially due to a reactive force on the stream exerted by the surface as a result of collision of the stream with the surface.

24 Claims, 3 Drawing Sheets

CONTINUOUS INK JET PRINTER WITH VARIABLE CONTACT DROP DEFLECTION

CROSS REFERENCE TO RELATED APPLICATIONS

Reference is made to commonly assigned, co-pending U.S. patent applications Ser. No. 08/955,562 entitled CONTINUOUS INK JET PRINTER WITH ELECTROSTATIC DROP DEFLECTION in the names of J. Chwalek and C. Anagnostopoulos filed on Oct. 17, 1997; Ser. No. 08/954,317 entitled CONTINUOUS INK JET PRINTER WITH ASYMMETRIC HEATING DROP DEFLECTION in the names of J. Chwalek, D. Jeanmaire, and C. Anagnostopoulos filed on Oct. 17, 1997; Ser. No. 08/954,681 entitled CONTINUOUS INK JET PRINTER WITH MICROMECHANICAL ACTUATOR DROP DEFLECTION in the names of J. Chwalek, G. Hawkins, and C. Anagnostopoulos filed on Oct. 17, 1997; and Ser. No. 08/953,610 entitled CONTINUOUS INK JET PRINTER WITH BINARY ELECTROSTATIC DEFLECTION in the names of J. Chwalek and D. Jeanmaire filed on Oct. 17, 1997. All of the above-listed applications were filed Oct. 17, 1997.

FIELD OF THE INVENTION

This invention relates generally to the field of digitally controlled printing devices, and in particular to continuous ink jet printheads which integrate multiple nozzles on a single substrate and in which the breakup of a liquid ink stream into droplets is caused by a periodic disturbance of the liquid ink stream.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high quality color images at a high-speed and low cost, using standard paper.

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop on demand ink jet. Continuous ink jet printing dates back to at least 1929. See U.S. Pat. No. 1,941,001 to Hansell.

U.S. Pat. No. 3,373,437, which issued to Sweet et al. in 1967, discloses an array of continuous ink jet nozzles wherein ink drops to be printed are selectively charged and deflected towards the recording medium. This technique is known as binary deflection continuous ink jet, and is used by several manufacturers, including Elmjet and Scitex.

U.S. Pat. No. 3,416,153, which issued to Hertz et al. in 1966, discloses a method of achieving variable optical density of printed spots in continuous ink jet printing using the electrostatic dispersion of a charged drop stream to modulate the number of droplets which pass through a small aperture. This technique is used in ink jet printers manufactured by Iris.

U.S. Pat. No. 3,878,519, which issued to Eaton in 1974, discloses a method and apparatus for synchronizing droplet formation in a liquid stream using electrostatic deflection by a charging tunnel and deflection plates.

U.S. Pat. No. 4,346,387, which issued to Hertz in 1982 discloses a method and apparatus for controlling the electric charge on droplets formed by the breaking up of a pressurized liquid stream at a drop formation point located within the electric field having an electric potential gradient. Drop formation is effected at a point in the field corresponding to the desired predetermined charge to be placed on the droplets at the point of their formation. In addition to charging tunnels, deflection plates are used to actually deflect drops.

Conventional continuous ink jet utilizes electrostatic charging tunnels that are placed close to the point where the drops are formed in a stream. In this manner individual drops may be charged. The charged drops may be deflected downstream by the presence of deflector plates that have a large potential difference between them. A gutter (sometimes referred to as a "catcher") may be used to intercept the charged drops, while the uncharged drops are free to strike the recording medium. In the current invention, the electrostatic charging tunnels are unnecessary.

DISCLOSURE OF THE INVENTION

It is an object of the present invention to provide a high speed apparatus and method of page width printing utilizing a continuous ink jet method whereby drop formation and deflection may occur at high repetition.

It is another object of the present invention to provide an apparatus and method of continuous ink jet printing with drop deflection means which can be integrated with the printhead utilizing the advantages of silicon processing technology offering low cost, high volume methods of manufacture.

It is yet another object of the present invention to provide an apparatus and method of high speed printing that can use a wide variety of inks.

It is still another object of the present invention to provide an apparatus and method for continuous ink jet printing that does not require electrostatic charging tunnels.

Accordingly, a feature of the present invention includes apparatus and process for controlling ink in a continuous ink jet printer in which a continuous stream of ink is emitted from a nozzle, wherein an ink stream generator establishes a continuous flow of ink in a stream such that the stream breaks up into a plurality of droplets at a position spaced from the ink stream generator. A stream deflector includes a body having a surface positioned adjacent to the stream between the ink stream generator and the position whereat the stream breaks up into droplets such that the stream contacts the surface and is deflected at least in part due to a tendency of liquid to contact a surface in proportion to liquid-solid free energy. The stream may be deflected substantially totally due to a tendency of liquid to contact a surface in proportion to liquid-solid free energy, or may be deflected partially due to a tendency of liquid to contact a surface in proportion to liquid-solid free energy and partially due to a reactive force on the stream exerted by the surface as a result of collision of the stream with the surface.

According to another feature of the present invention, an electrode and a drop deflection control circuit adapted to selectively change the electrical potential of the ink relative to the body, thereby altering the surface energy per unit area between the ink and the surface to control the direction of the stream between a print direction and a non-print direction.

According to yet another feature of the present invention, a plurality of stream deflectors may be positioned around the periphery of the nozzle bore. The bodies are electrically separated from one another and are individually activated, whereby the stream may be selectively steered according to selected application of a voltage to any one or more of the bodies.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 2(*b*) is a top view of the nozzle of FIG. 2(*a*).

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
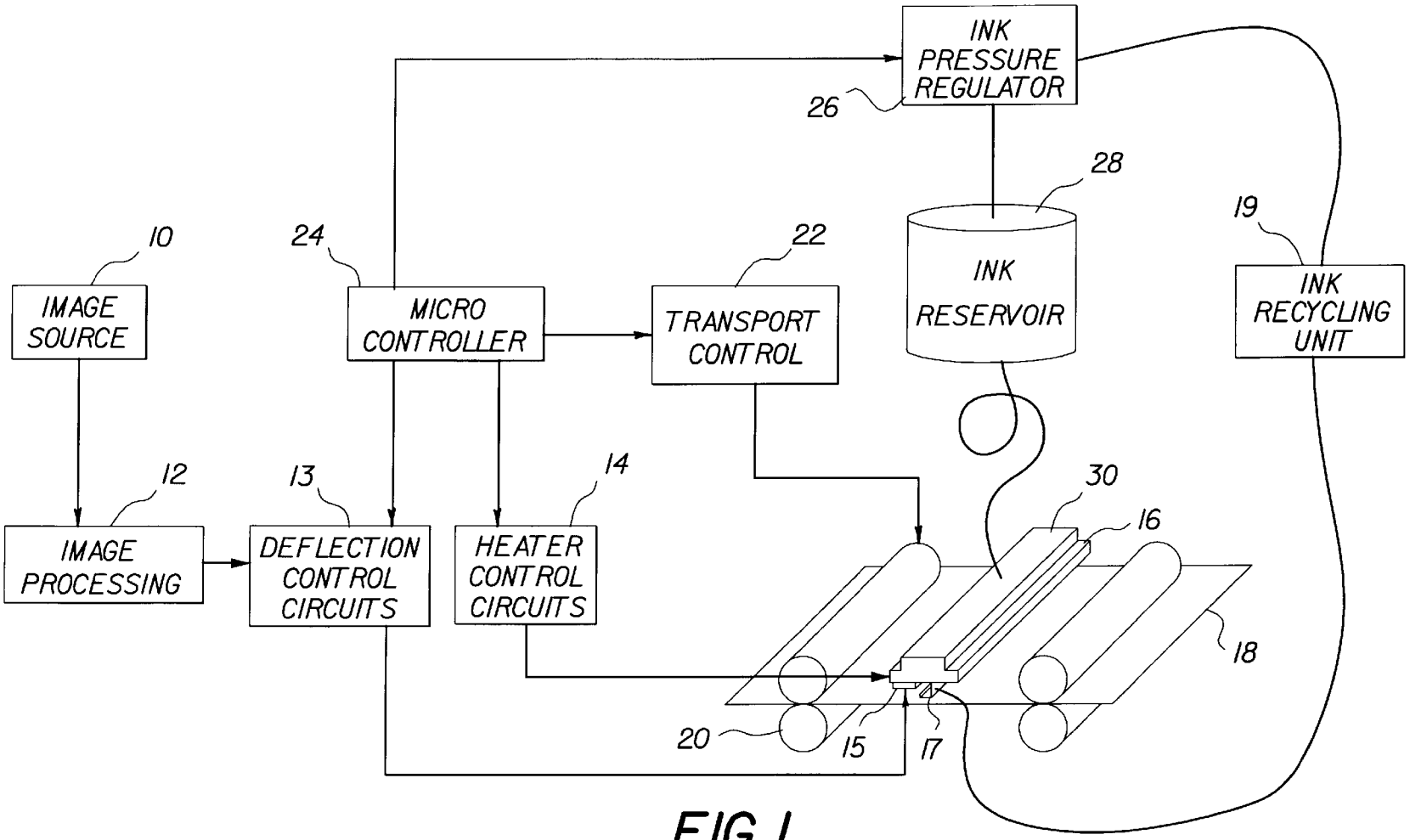
FIG. 1 shows a simplified block schematic diagram of one exemplary printing apparatus according to the present invention.

Referring to FIG. 1, a continuous ink jet printer system includes an image source 10 such as a scanner or computer which provides raster image data, outline image data in the form of a page description language, or other forms of digital image data. This image data is converted to half-toned bitmap image data by an image processing unit 12 which also stores the image data in memory. A plurality of drop deflection control circuits 13 read data from the image memory and apply time-varying electrical pulses to a drop deflection means 15. Time-varying electrical pulses are supplied to a plurality of heater control circuits 14 that supply electrical energy to a set of nozzle heaters 50, FIG. 2(*a*), that are part of a printhead 16. These pulses are applied at an appropriate time, and to the appropriate nozzle, so that drops formed from a continuous ink jet stream will form spots on a recording medium 18 in the appropriate position designated by the data in the image memory.

Recording medium 18 is moved relative to printhead 16 by a recording medium transport system 20, and which is electronically controlled by a recording medium transport control system 22, which in turn is controlled by a micro-controller 24. The recording medium transport system shown in FIG. 1 is a schematic only, and many different mechanical configurations are possible. For example, a transfer roller could be used as recording medium transport system 20 to facilitate transfer of the ink drops to recording medium 18. Such transfer roller technology is well known in the art. In the case of page width printheads, it is most convenient to move recording medium 18 past a stationary printhead. However, in the case of scanning print systems, it is usually most convenient to move the printhead along one axis (the sub-scanning direction) and the recording medium along the orthogonal axis (the main scanning direction) in a relative raster motion.

Micro-controller 24 may also control an ink pressure regulator 26, drop deflection control circuits 13, and heater control circuits 14. Ink is contained in an ink reservoir 28 under pressure. In the non-printing state, continuous ink jet drop streams are unable to reach recording medium 18 due to an ink gutter 17 that blocks the stream and which may allow a portion of the ink to be recycled by an ink recycling unit 19. The ink recycling unit reconditions the ink and feeds it back to reservoir 28. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 28 under the control of ink pressure regulator 26.

The ink is distributed to the back surface of printhead 16 by an ink channel device 30. The ink preferably flows through slots and/or holes etched through a silicon substrate of printhead 16 to its front surface, where a plurality of nozzles and heaters are situated. With printhead 16 fabricated from silicon, it is possible to integrate drop deflection control circuits 13 and heater control circuits 14 with the printhead.

Figure 2A:
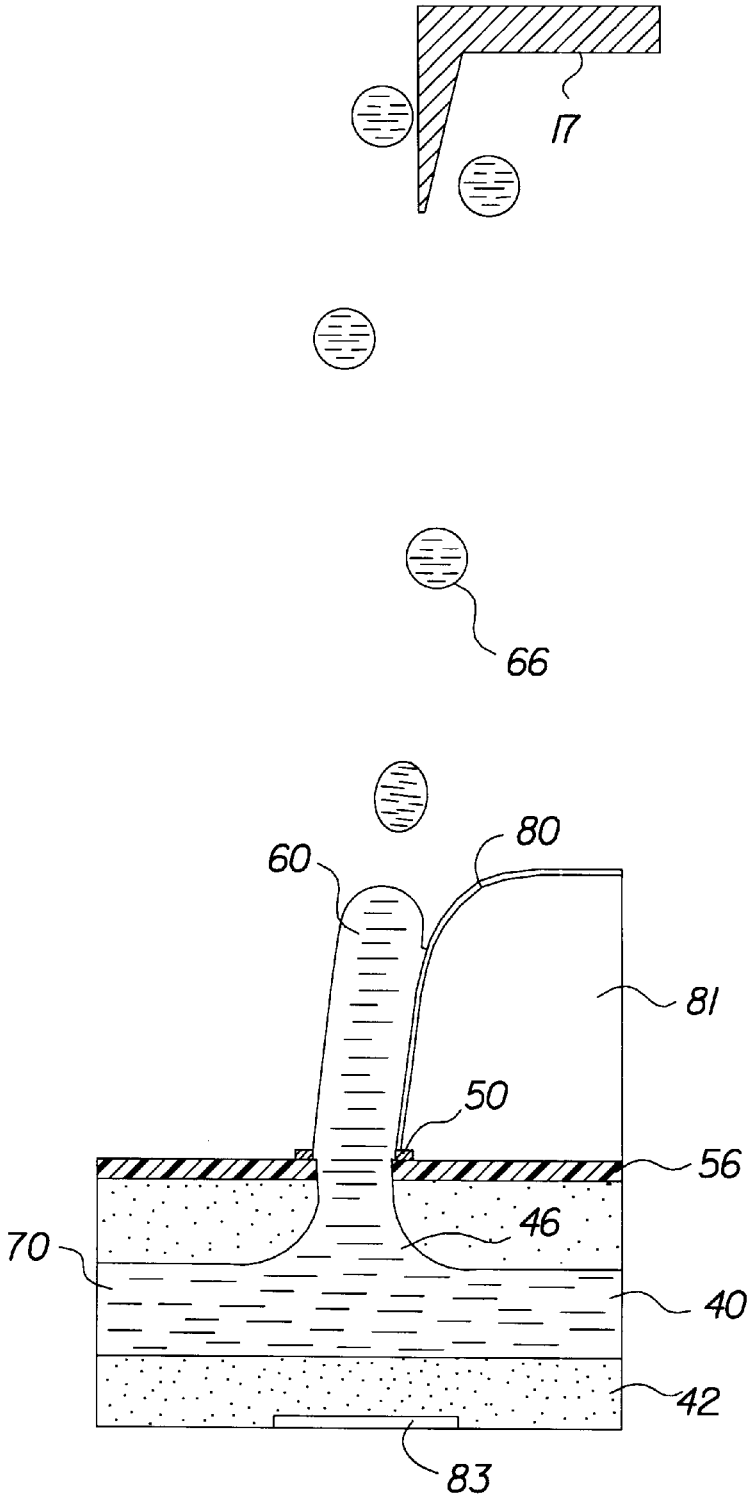
FIG. 2(*a*) shows a cross section of a portion of a nozzle with drop deflection by variable contact wetting.
Figure 2B:
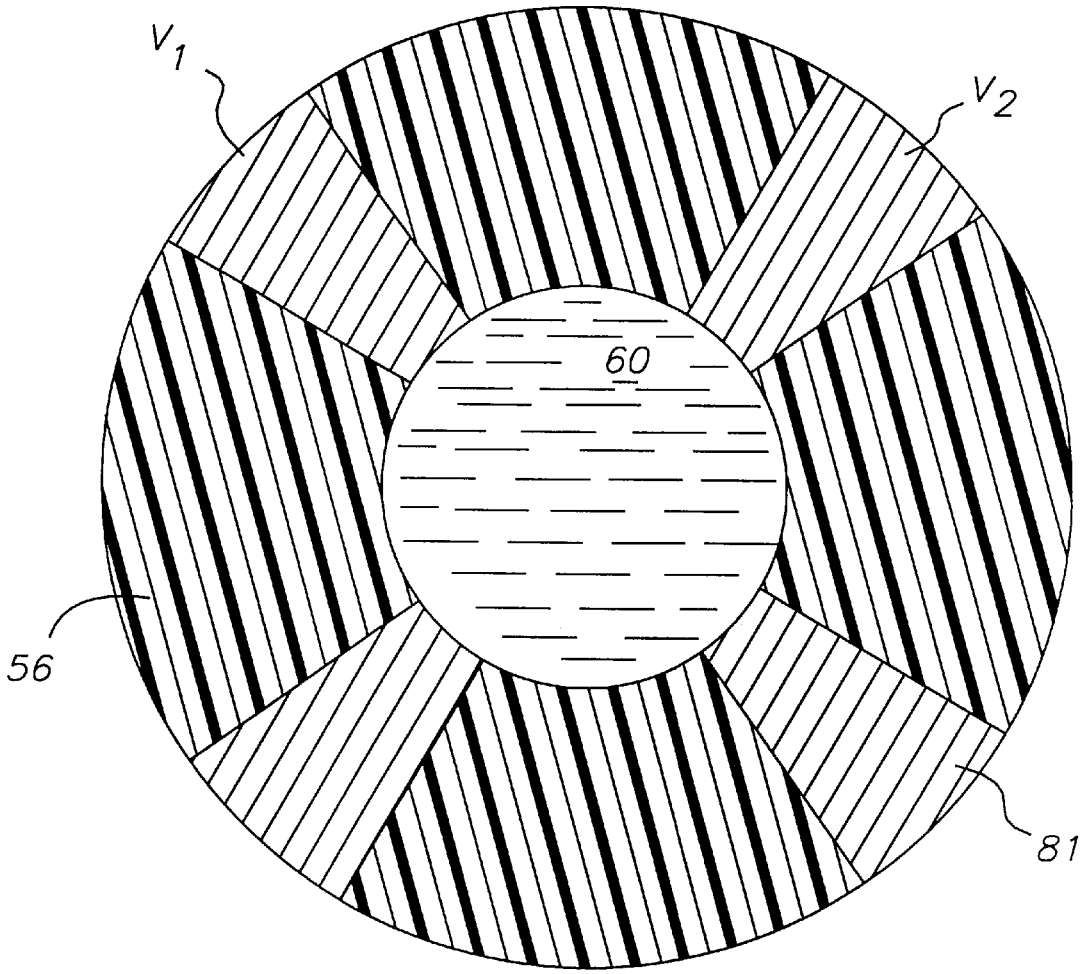

FIG. 2(*a*) is a cross-sectional view of one nozzle tip of an array of such tips that form continuous ink jet printhead 16 of FIG. 1 according to a preferred embodiment of the present invention. An ink delivery channel 40, along with a plurality of nozzle bores 46 are etched in a substrate 42, which is silicon in this example. Delivery channel 40 and nozzle bores 46 may be formed by anisotropic wet etching of silicon, using a $p^+$ etch stop layer to form the nozzle bores. Ink 70 in delivery channel 40 is pressurized above atmospheric pressure, and forms a stream 60. At a distance above nozzle bore 46, stream 60 breaks up into a plurality of drops 66 due to heat supplied by a heater 50.

The stream contacts a solid surface layer 80 after leaving the nozzle and before breaking up into drops 66. Surface layer 80 covers a conductive body 81. Deflection of the stream results from contact of the stream with surface layer 80; the region of contact lying in a direction substantially along the direction of flow of the stream. It is a significant feature of this embodiment that the stream breaks up into drops after contact with surface layer 80. Preferably, the distance from the nozzle to the furthest point of contact between the stream and the surface layer is less than or about the distance from the nozzle to the point in the stream at which the stream breaks up into drops due to heat supplied by heater 50 in the absence of surface layer 80, in order that the stream remain in cylindrical form when in contact with surface 80. This technology is distinct from that of prior art systems of continuous stream deflection printers which rely upon deflection of drops previously separated from their respective streams.

Surface layer 80 serves to deflect stream 60 due to the tendency of liquid ink 70 in the stream to contact the solid surface in proportion to the liquid-solid free energy. This phenomenon, while know extensively in the art of characterization of profiles of static liquids in contact with surfaces, is applied advantageously in the present invention to profile a moving liquid stream in contact with a surface. While having no particular effect on the liquid solid free energy, the use of a moving steam affords control of the position of subsequently separated drops. The stream as shown in FIG. 2(*a*) is deflected compared with the direction of flow the stream would assume if body 81 and surface layer 80 had been withdrawn from contact with the stream. In the present embodiment, the stream is deflected in a direction toward surface layer 80 due to the gain in free energy of the system caused by physical contact between ink 70 and surface layer 80 where the stream contacts the surface layer, as is the case for static liquids whose shapes deform upon contact with solid surfaces. Another mode of deflection may be achieved by positioning conductive body 81 closer to the center of the stream (toward the left in FIG. 2(*a*)) thereby deflecting the stream in a direction opposite to the contact area. In this case, the deflection is only partially a result of the effects of surface free energy and is also caused by the reactive force on the stream exerted by the surface layer due to collision of the stream with the layer.

Selective steering of stream 60 is achieved in accordance with the present invention by altering an electrically induced change of the surface energy between ink 70 and surface layer 80, thereby changing the amount of stream deflection. This change in the surface energy is provided by selectively applying a potential difference between conductive body 81 and an electrode 83 which is in electrical contact with ink 70. The potential difference is controlled by the drop deflection control circuits 13. Electrode 83 is shown in FIG. 2(*a*) positioned in or near bore 46 in order to control the electric potential of ink 70. Alternatively, electrical contact with the ink to control its potential may be made by conductive surfaces, such as metallic surfaces, which could be used for the walls of delivery channel 40. It is also a preferable embodiment to control the electric potential of ink 70 by capacitive coupling, as is the case if electrode 83 is separated entirely from the ink by a thin dielectric film (not shown), as is well known in the art of electrostatics. The amount of deflection is determined by the extent to which the surface energy per unit area between liquid and surface layer 80 is altered by application of potential, and by the geometry of surface layer 80. The value of potential required to alter the surface free energy between the liquid ink stream and surface layer 80 is advantageously not large, provided that surface layer 80 is thin. For example, surface layer 80 is preferably in the range of from 100 Å to 1 $\mu$m thick. Changes of free energy of at least 10 percent of the free energy in the absence of an applied potential can be achieved for such geometries upon application of only a few volts, as is known from studies of liquid solid contact angles. Changes in the surface free energy are caused by charges induced in ink 70 and in conductive body 81 and also by absorption of chemical species at the interface between ink 70 and surface layer 80.

The geometry of surface layer 80 determines the extent of change in the area of contact of the steam and the surface layer that occurs when the liquid-solid free energy is altered and thus determines the extent to which the initial stream deflection is changed. This geometry may be advantageously chosen to produce the desired range of drop deflection. It is important to recognize, in accordance with the present invention, that there is always a deflection of the stream, the final deflection being determined by selectively modulating the deflection.

Although the invention has been described above in terms of steering a stream in a single direction by means of a single conductive body 81, there is generally a need to steer streams in an arbitrary direction to correct for errors of ink drop placement on the receiver. Thus the scope of the present invention is not limited to steering in a single direction, and includes means of steering in multiple directions by the inclusion of more than one steering means disposed at an angle, for example 90 degrees, with respect to one another, as shown in the top view to FIG. 2(*b*). In FIG. 2(*b*), four conductive bodies 81, which are electrically separated from one another, are disposed so as to enable steering of the stream in any of four directions corresponding to application of a voltage to any one of the conductive bodies 81. The stream may be steered in an arbitrary direction, for example in a direction between conductive bodies 81 by applying voltages simultaneously to adjacent conductive bodies 81. For example, FIG. 2(*b*) shows voltages $V_1$ and $V_2$ being applied to respective conductive bodies 81 to effect deflection in the direction of the arrow in FIG. 2(*b*). Advantageously, the sign of the voltages $V_1$ and $V_2$ may be chosen to be different, since the direction of steering for any one conductive body 81 does not depend on the sign of the applied voltage. Such a choice minimizes the total charges induced in the stream because charges of opposite sign are induced in the stream near the first and second conductive bodies.

Although an array of streams is not required in the practice of this invention, a device comprising an array of streams may be desirable to increase printing rates. In this case, deflection and modulation of individual streams may be accomplished as described for a single stream in a simple and physically compact manner, because such deflection relies only on application of a small potential, which is easily provided by conventional integrated circuit technology, for example CMOS technology.

The invention has been described in detail with particular reference to preferred embodiments thereof, but it will be understood that variations and modifications can be effected within the spirit and scope of the invention.

What is claimed is:

1. Apparatus for controlling ink in a continuous ink jet printer in which a continuous stream of ink is emitted from a nozzle; said apparatus comprising:

an ink stream generator which establishes a continuous flow of ink in a cylindrical stream, said stream breaking up into a plurality of droplets at a position spaced from the ink stream generator; and a stream deflector including a body having a surface positioned adjacent to the cylindrical stream between the ink stream generator and the position whereat the stream breaks up into droplets such that the cylindrical stream contacts the surface and the cylindrical stream is deflected at least in part due to a tendency of liquid to contact a surface in proportion to liquid-solid free energy.

2. Apparatus as set forth in claim 1, wherein the stream deflector is positioned such that the stream is deflected substantially totally due to a tendency of liquid to contact a surface in proportion to liquid-solid free energy.

3. Apparatus as set forth in claim 1, wherein the stream deflector is positioned such that the stream is deflected partially due to a tendency of liquid to contact a surface in proportion to liquid-solid free energy and partially due to a reactive force on the stream exerted by the surface as a result of collision of the stream with the surface.

4. Apparatus as set forth in claim 1, further comprising:

an electrode; and a drop deflection control circuit adapted to selectively change the electrical potential of the electrode to control the electric potential of the ink relative to the body, thereby to alter the surface energy per unit area between the ink and the surface to control the direction of the stream between a print direction and a non-print direction.

5. Apparatus as set forth in claim 4, wherein said electrode is in electrical contact with the ink.

6. Apparatus as set forth in claim 4, wherein said surface layer has a thickness of from about 100 Å to about 1 $\mu$m.

7. Apparatus as set forth in claim 4, wherein:

there are a plurality of stream deflectors positioned around the periphery of the nozzle bore; and the body of each stream deflector is electrically separated from the body of each other stream deflector and is individually activated, whereby the stream is selectively steerable according to selected application of a voltage to any one or more of the bodies.

8. Apparatus as set forth in claim 7, wherein there are four stream deflectors positioned around the periphery of the nozzle bore at relative angles of about 90 degrees.

9. Apparatus as set forth in claim 1, wherein the ink stream generator comprises:

an ink delivery channel;

a source of ink communicating with the ink delivery channel, wherein the ink is pressurized above atmospheric pressure; and a nozzle bore which opens into the ink delivery channel.

10. Apparatus for controlling ink in a continuous ink jet printer in which a continuous stream of ink is emitted from a nozzle, said apparatus comprising:

an ink stream generator which establishes a continuous flow of ink in a stream, a droplet generator which causes the stream to break up into a plurality of droplets at a position spaced from the ink stream generator; and a stream deflector including a body having a surface positioned adjacent to the stream between the ink stream generator and the position whereat the stream breaks up into droplets such that the stream contacts the surface and the stream is deflected at least in part due to a tendency of liquid to contact a surface in proportion to liquid-solid free energy, the stream deflector being positioned a distance from the stream generator which is no more than about one half the distance from the stream generator to the position at which the stream is caused to break up into droplets.

11. Apparatus as set forth in claim 10, wherein the stream deflector is positioned such that the stream is deflected substantially totally due to a tendency of liquid to contact a surface in proportion to liquid-solid free energy.

12. Apparatus as set forth in claim 10, wherein the stream deflector is positioned such that the stream is deflected partially due to a tendency of liquid to contact a surface in proportion to liquid-solid free energy and partially due to a reactive force on the stream exerted by the surface as a result of collision of the stream with the surface.

13. Apparatus as set forth in claim 10, further comprising:

an electrode; and a drop deflection control circuit adapted to selectively change the electrical potential of the electrode to control the electric potential of the ink relative to the body, thereby to alter the surface energy per unit area between the ink and the surface to control the direction of the stream between a print direction and a non-print direction.

14. Apparatus as set forth in claim 13, wherein said electrode is in electrical contact with the ink.

15. Apparatus as set forth in claim 13, wherein said surface layer has a thickness of from about 100 Å to about 1 $\mu$m.

16. Apparatus as set forth in claim 13, wherein:

there are a plurality of stream deflectors positioned around the periphery of the nozzle bore; and the body of each stream deflector is electrically separated from the body of each other stream deflector and is individually activated, whereby the stream is selectively steerable according to selected application of a voltage to any one or more of the bodies.

17. Apparatus as set forth in claim 13, wherein there are four stream deflectors positioned around the periphery of the nozzle bore at relative angles of about 90 degrees.

18. Apparatus as set forth in claim 10, wherein the ink stream generator comprises:

an ink delivery channel;

a source of ink communicating with the ink delivery channel, wherein the ink is pressurized above atmospheric pressure; and a nozzle bore which opens into the ink delivery channel.

19. Apparatus as set forth in claim 10, wherein the droplet generator is a heater.

20. A process for controlling ink in a continuous ink jet printer in which a continuous cylindrical stream of ink is emitted from a nozzle; said process comprising:

establishing a continuous flow of ink in a cylindrical stream which breaks up into a plurality of droplets at a position spaced from the nozzle; and contacting the cylindrical stream by a body having a surface positioned adjacent to the cylindrical stream between the nozzle and the position whereat the stream breaks up into droplets such that the stream is deflected at least in part due to a tendency of liquid to contact a surface in proportion to liquid-solid free energy.

21. The process as set forth in claim 20, wherein the step of establishing a continuous flow of ink in a stream comprises:

providing an ink delivery channel;

providing a source of ink communicating with the ink delivery channel;

pressurizing the ink in the delivery channel above atmospheric pressure; and providing a nozzle bore which opens into the ink delivery channel.

22. The process as set forth in claim 20, further comprising positioning the body such that the stream is deflected substantially totally due to a tendency of liquid to contact a surface in proportion to liquid-solid free energy.

23. The process as set forth in claim 20, further comprising positioning the body such that the stream is deflected partially due to a tendency of liquid to contact a surface in proportion to liquid-solid free energy and partially due to a reactive force on the stream exerted by the body as a result of collision of the stream with the body.

24. The process as set forth in claim 20, further comprising:

selectively controlling the electric potential of the ink relative to the body, thereby to alter the surface energy per unit area between the ink and the surface to control the direction of the stream between a print direction and a non-print direction.

* * * * *